US010295322B1

(12) United States Patent
Burke et al.

(10) Patent No.: US 10,295,322 B1
(45) Date of Patent: May 21, 2019

(54) STUCK AMMUNITION SHELL REMOVER

(71) Applicant: Battenfeld Technologies, Inc., Columbia, MO (US)

(72) Inventors: Justin Burke, Columbia, MO (US); James Tayon, Moberly, MO (US); Michael Cottrell, Columbia, MO (US); Anthony Vesich, Columbia, MO (US); Dennis W. Cauley, Booneville, MO (US); Timothy Kinney, Warrenton, MO (US); Mark Dalton, Columbia, MO (US); Matthew Kinamore, Columbia, MO (US); James Gianladis, Harrisburg, MO (US); Michael Poehlman, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 15/870,479

(22) Filed: Jan. 12, 2018

(51) Int. Cl.

| | |
|---|---|
| ***F42B 33/02*** | (2006.01) |
| ***F42B 33/00*** | (2006.01) |
| ***B25B 27/14*** | (2006.01) |
| ***F42B 33/10*** | (2006.01) |

(52) U.S. Cl.
CPC ..... *F42B 33/02* (2013.01); *B25B 27/14* (2013.01); *F42B 33/10* (2013.01)

(58) Field of Classification Search
None
See application file for complete search history.

(56) References Cited

U.S. PATENT DOCUMENTS

| | | | | | |
|---|---|---|---|---|---|
| 2,744,307 | A * | 5/1956 | Smiley | B23B 5/168 | 29/57 |
| 3,025,743 | A * | 3/1962 | Cecchi | F42B 39/10 | 279/114 |
| 3,107,575 | A * | 10/1963 | Paul | F42B 33/10 | 269/254 R |
| 3,157,407 | A * | 11/1964 | Aulabaugh | F42B 33/10 | 279/36 |
| 3,185,019 | A * | 5/1965 | Shoffstall | F42B 33/002 | 279/121 |
| 3,319,511 | A * | 5/1967 | McLean | F42B 33/002 | 86/23 |
| 3,345,903 | A * | 10/1967 | Purdie | F42B 33/002 | 86/23 |
| 3,896,699 | A * | 7/1975 | Cerro | F42B 33/002 | 269/254 R |
| 3,916,758 | A * | 11/1975 | Ashbrook | F42B 33/002 | 279/46.7 |
| 4,425,833 | A * | 1/1984 | Purdie | F42B 33/002 | 86/26 |
| 4,732,073 | A * | 3/1988 | Semon | F42B 33/04 | 15/104.2 |

(Continued)

*Primary Examiner* — Derrick R Morgan
(74) *Attorney, Agent, or Firm* — Stinson Leonard Street LLP

(57) ABSTRACT

A stuck shell remover and associated methods. The stuck shell remover is mountable on an ammunition press. The stuck shell remover includes a clamp that is clampable on a shell stuck in a die on the ammunition press. When the clamp is clamped on the stuck shell, the ammunition press can be actuated to pull the suck shell out of the die. The stuck shell remover may include a press connector that is movable with respect to the clamp to permit proper alignment.

22 Claims, 10 Drawing Sheets

(56) References Cited

U.S. PATENT DOCUMENTS

| | | | | |
|---|---|---|---|---|
| 6,260,463 | B1 * | 7/2001 | Brand | F42B 33/04 86/24 |
| 6,772,668 | B2 * | 8/2004 | Shields | F42B 33/02 86/27 |
| 7,395,746 | B2 * | 7/2008 | Bond | F42B 33/001 86/24 |
| 9,846,018 | B1 * | 12/2017 | Schloer | F42B 33/002 |
| 2018/0354111 | A1 * | 12/2018 | Getchell | B25B 27/062 |

* cited by examiner

STUCK AMMUNITION SHELL REMOVER

FIELD

The present disclosure generally relates to ammunition loading, and more particularly to a tool for removing a stuck ammunition shell from a die on a loading press.

BACKGROUND

When loading or reloading ammunition, a press is commonly used to perform various operations. Loading presses can have various configurations. In many instances, a die is mounted on the press, and a lever actuated ram having a shell holder holding an ammunition shell (sometimes called a case) is used to move the shell into engagement with the die to perform an operation on the shell. For example, the shell may be moved into a sizing or resizing die to size the shell to desired dimensions. Sometimes shells become stuck in sizing dies or other types of dies and are difficult to remove. The shell holder typically holds the shell by its rim (sometimes called a flange) and is insufficient to remove the stuck shell. If the user attempts to pull on the shell with the lever actuated ram to remove the shell from the die, the rim of the shell deforms and the shell holder can no longer grip the shell to pull it out of the die.

SUMMARY

In one aspect, a stuck shell remover is for removing a stuck ammunition shell from a die on an ammunition press. The stuck shell remover includes a clamp and an ammunition press connector. The clamp includes a first jaw, a second jaw, and a base supporting the first and second jaws. The first jaw is movable with respect to the second jaw between a retracted position and a clamping position. The first jaw in the retracted position is a first distance from the second jaw to receive the shell therebetween. The first jaw in the clamping position is a second distance less than the first distance from the second jaw for clamping the shell. The ammunition press connector is secured to the clamp and configured to connect to the ammunition press.

In another aspect, a method is for using an stuck shell remover to remove a stuck ammunition shell from a die on an ammunition press. The method includes connecting an ammunition press connector of the stuck shell remover to the ammunition press to mount the stuck shell remover on the ammunition press. The press is actuated to move a clamp of the stuck shell remover toward the stuck ammunition shell. The stuck ammunition shell is clamped by the clamp. The press is actuated to move the clamp away from the die to remove the stuck ammunition shell from the die.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
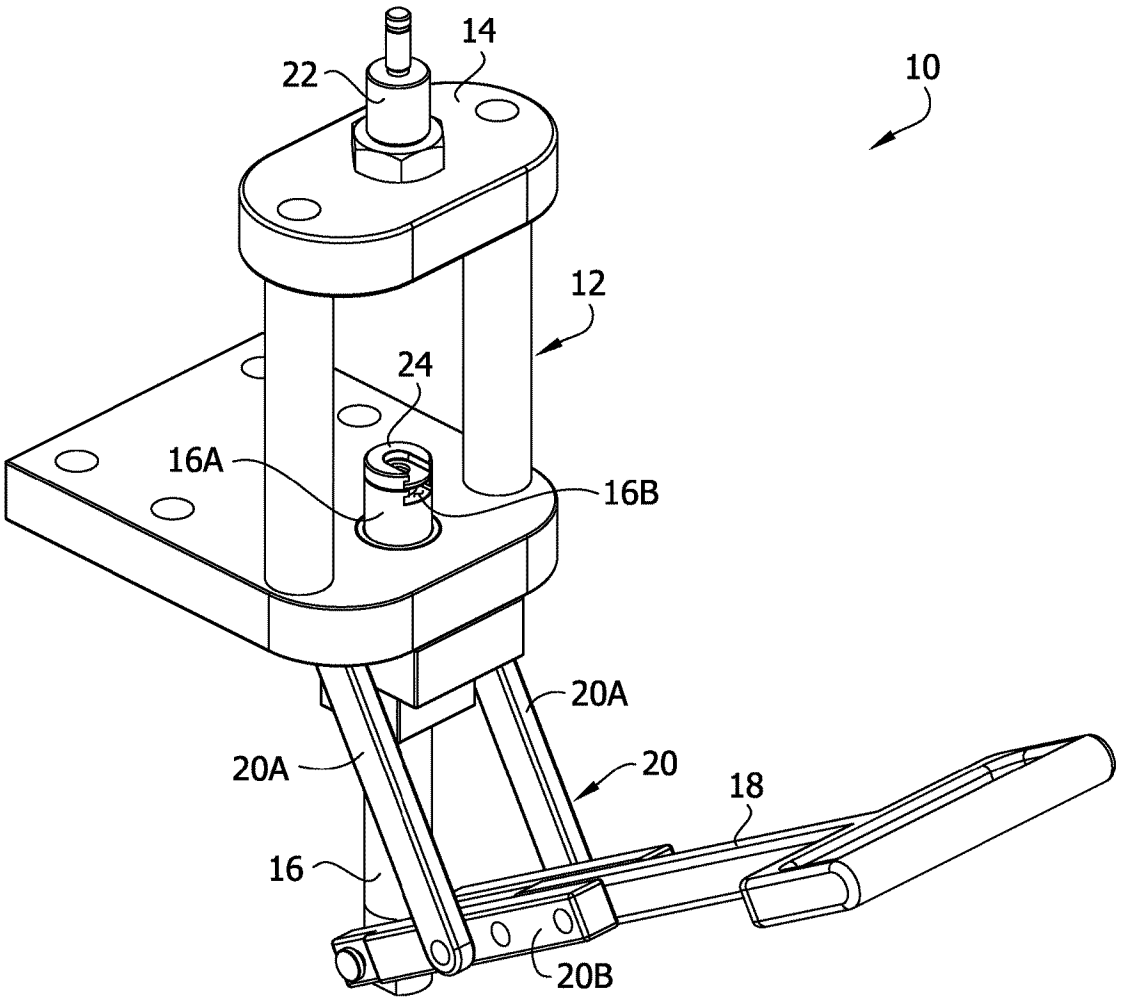
FIG. 1 is a perspective of an ammunition press including a shell ram and a die.

Referring to FIG. 1, an ammunition press is designated generally by the reference number 10. Many types of ammunition presses are known, and the press 10 is shown by example without limitation. The illustrated press 10 includes a frame 12, a die holder 14, a ram 16, and an actuator 18. The actuator 18 is provided in the form of a lever and is operatively connected to the ram 16 to move the ram by a linkage 20 including first and second links 20A and a bracket 20B. A die 22 is mounted on the die holder 14. For example, the die 22 may be a sizing die configured to size an ammunition shell C (sometimes referred to as a shell) to a desired dimension. Other types of dies can also be used on the ammunition press 10. The ram 16 includes a shell holder connector 16A to which a shell holder 24 is connected. The shell holder connector 16A defines a recess 16B into which the shell holder is laterally slidable. A bottom shoe of the shell holder 24 is captured by a flange 16C (FIG. 7) of the shell holder connector 16A. The ram 16 is provided in the form of a shaft movable toward and away from the die 22 by movement of the lever 18. A user mounts a shell C on the ram 16 by sliding a rim (i.e., flange) of the shell laterally into the shell holder 24. The lever 18 is then actuated to move the shell C into engagement with the die 22 to perform an operation on the shell C such as sizing the shell. In addition, or alternatively, the die 22 may include a depriming pin 22A (FIG. 7) configured to push a spent primer out of a primer pocket of the shell. The depriming pin 22A is secured to a top of the die and extends downward in a shell receiving bore of the die such that as the shell moves upward into the die the depriming pin pushes the spent primer out of the shell. Sometimes the shell C may become stuck in the die 22. When the shell C is stuck in the die 22, if the user actuates the lever 18 to move the shell holder 24 downward to remove the shell, the rim of the shell may become deformed such that the shell holder loses its grip on the shell and moves downward without the shell. The user may remove the die 22 from the press 10 and use other tools to remove the shell C from the die.

It will be appreciated that the press 10 illustrated in FIG. 1 and described above is for example without limitation. Other types of presses can be used without departing from the scope of the present invention. For example, presses having other drive mechanisms (e.g., other styles of rams, shell holder connectors, linkages, actuators, etc.) can be used. Moreover, other types of dies may be used and may be fixed components of the press rather than removable. In other embodiments of presses, components of the press 10 may be omitted and/or additional components may be provided.

Figure 1A:
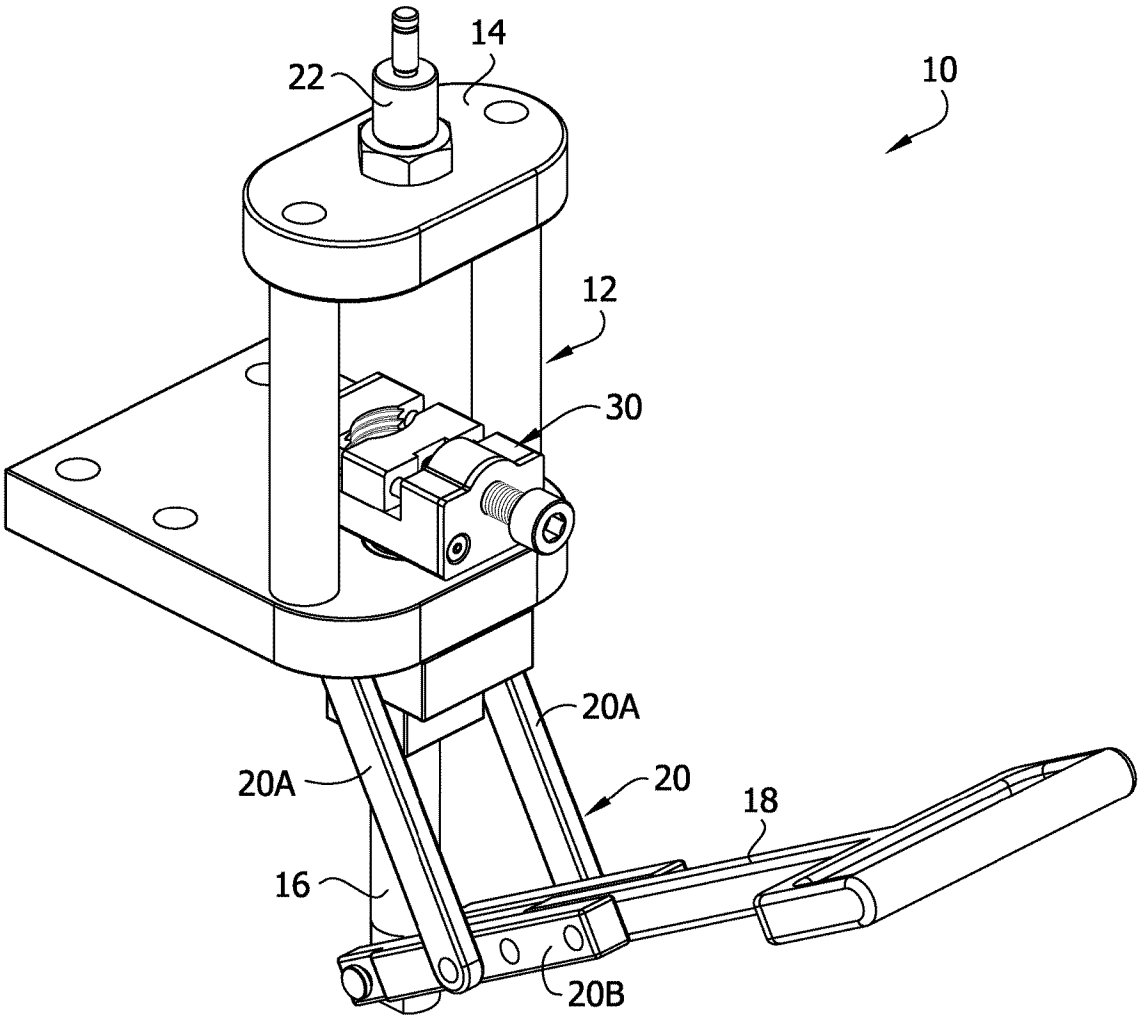
FIG. 1A is a perspective of the ammunition press having a stuck shell remover mounted thereon.
Figure 2:
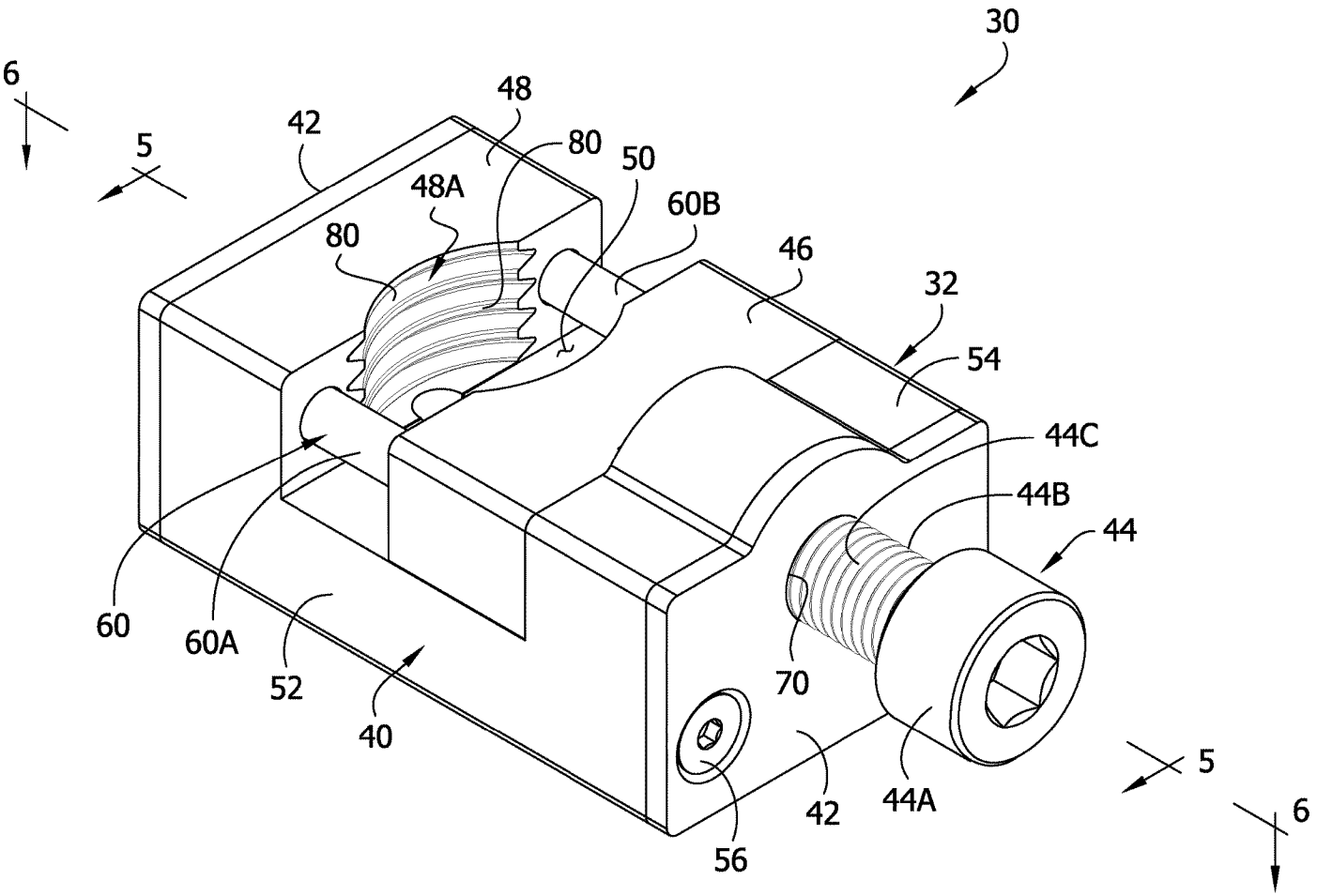
FIG. 2 is a front perspective of the stuck shell remover.
Figure 7:
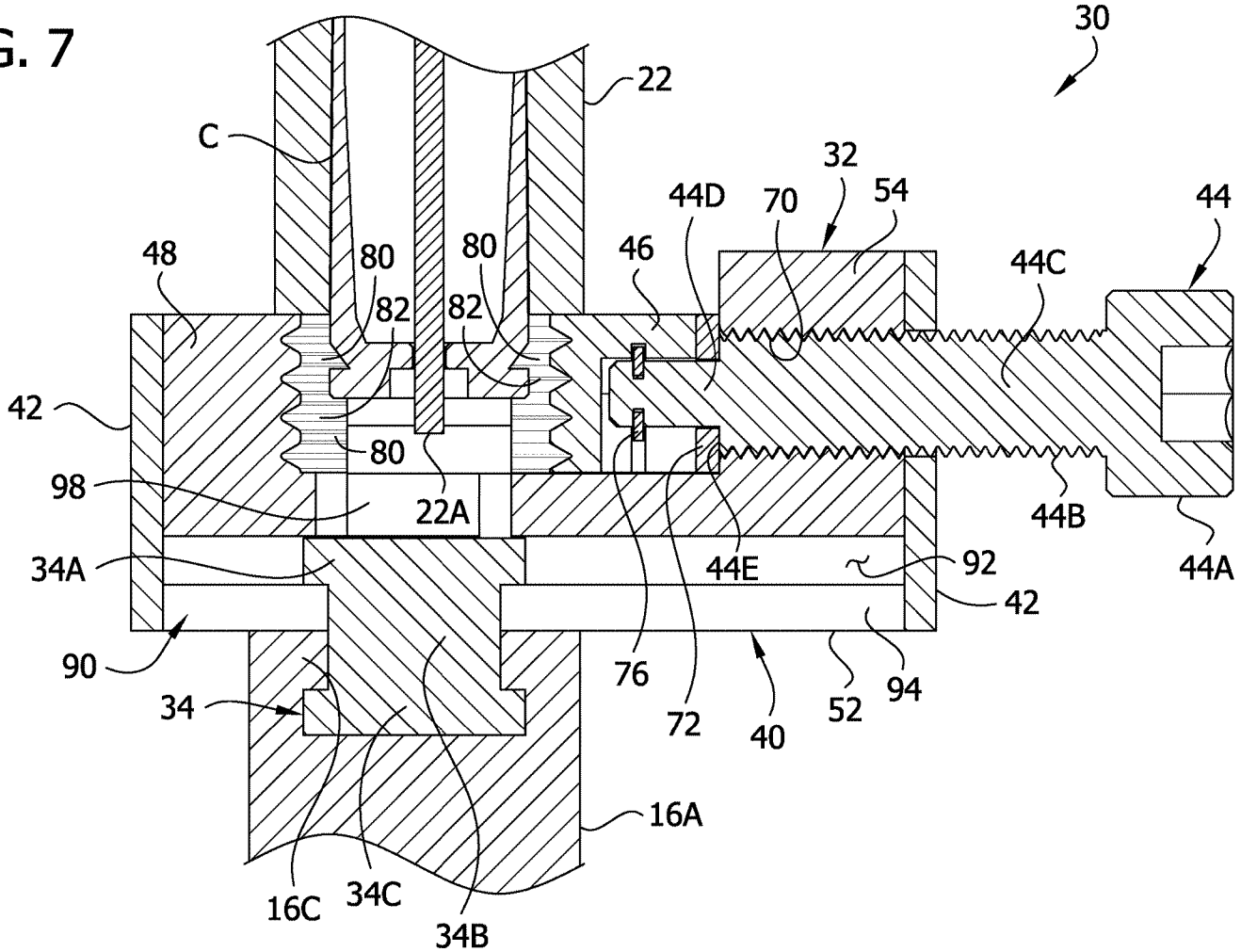
FIG. 7 is a fragmentary elevation of the stuck shell remover shown in section mounted on the press and positioned for clamping a shell stuck in the die.
Figure 8:
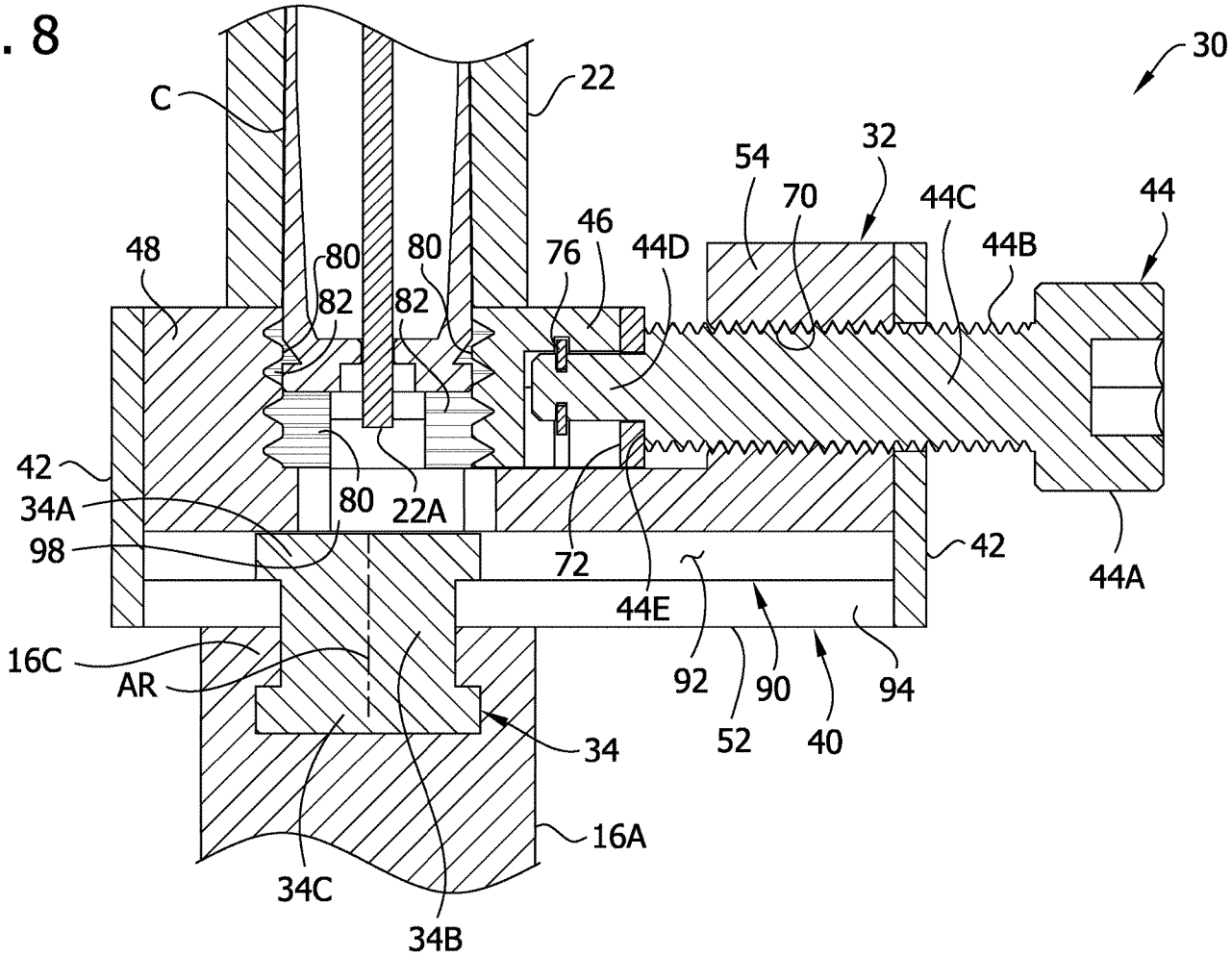
FIG. 8 is a view similar to FIG. 7 but showing the stuck shell remover clamped on the stuck shell.
Figure 9:
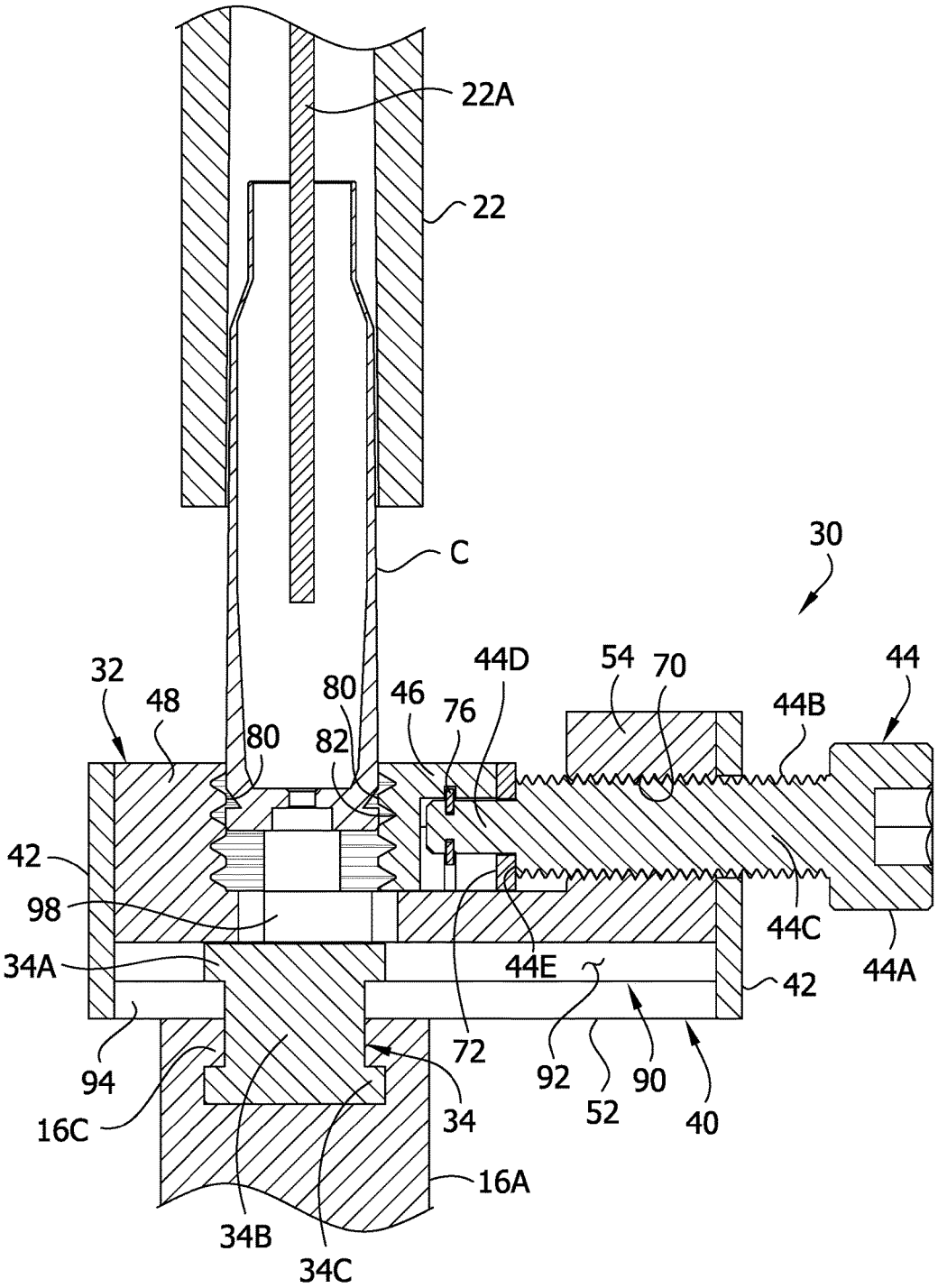
FIG. 9 is a view similar to FIG. 8 but showing the clamp removing the shell from the die.

Referring to FIGS. 1A-4, a stuck shell remover of the present invention is designated generally by the reference number 30. As shown in FIG. 1A, the stuck shell remover is mountable on the press 10. The stuck shell remover 30 is usable to remove a stuck shell C from the die 22. The stuck shell remover 30 generally includes a clamp 32 and a press connector 34. As will be explained in further detail below, the press connector 34 is configured to connect the stuck shell remover 30 to the press 10, and the clamp 32 is configured to clamp the stuck shell C to remove the stuck shell from the die 22. Use of the stuck shell remover on the press 10 is illustrated in FIGS. 7-9, in which the stuck shell remover 30 and die 22 are shown in section but shell is not in section. The stuck shell remover 30 permits the user to use the mechanical advantage of the press 10 to remove the stuck shell C. The components of the stuck shell remover 30 can be formed of any suitable material, such as metal.

The clamp 32 generally includes a main body 40, two end caps 42, and an actuator 44 in the form of a bolt. The clamp 32 includes a movable (first) jaw 46 movable by the bolt and a fixed (second) jaw 48. The jaws 46, 48 include respective jaw faces 46A, 48A configured to engage the shell C to clamp the shell. The clamp 32 defines a shell recess 50 between the jaws 46, 48 in which the stuck shell C is receivable for clamping the stuck shell with the jaws. The main body 40 includes a base 52 and a hub 54 secured to the base. The fixed jaw 48 is secured to and immovable with respect to the base 52. In the illustrated embodiment, the hub 54 and the jaw 48 are formed as one piece with the base 52. The end caps 42 are provided in the form of plates and are secured to opposite ends of the base by fasteners 56 (e.g., screws) for reasons which will become apparent. The hub 54 supports the bolt 44 for moving the movable jaw 46 between a retracted position (e.g., FIGS. 2, 3, 5, 6, 7) and a clamping position (e.g., FIGS. 8, 9) in which the movable jaw is closer to the fixed jaw 48. In the illustrated embodiment, only one jaw 46 is movable with respect to the base 52, but it will be appreciated that both of the jaws 46, 48 can be movable without departing from the scope of the present invention.

Figure 5:
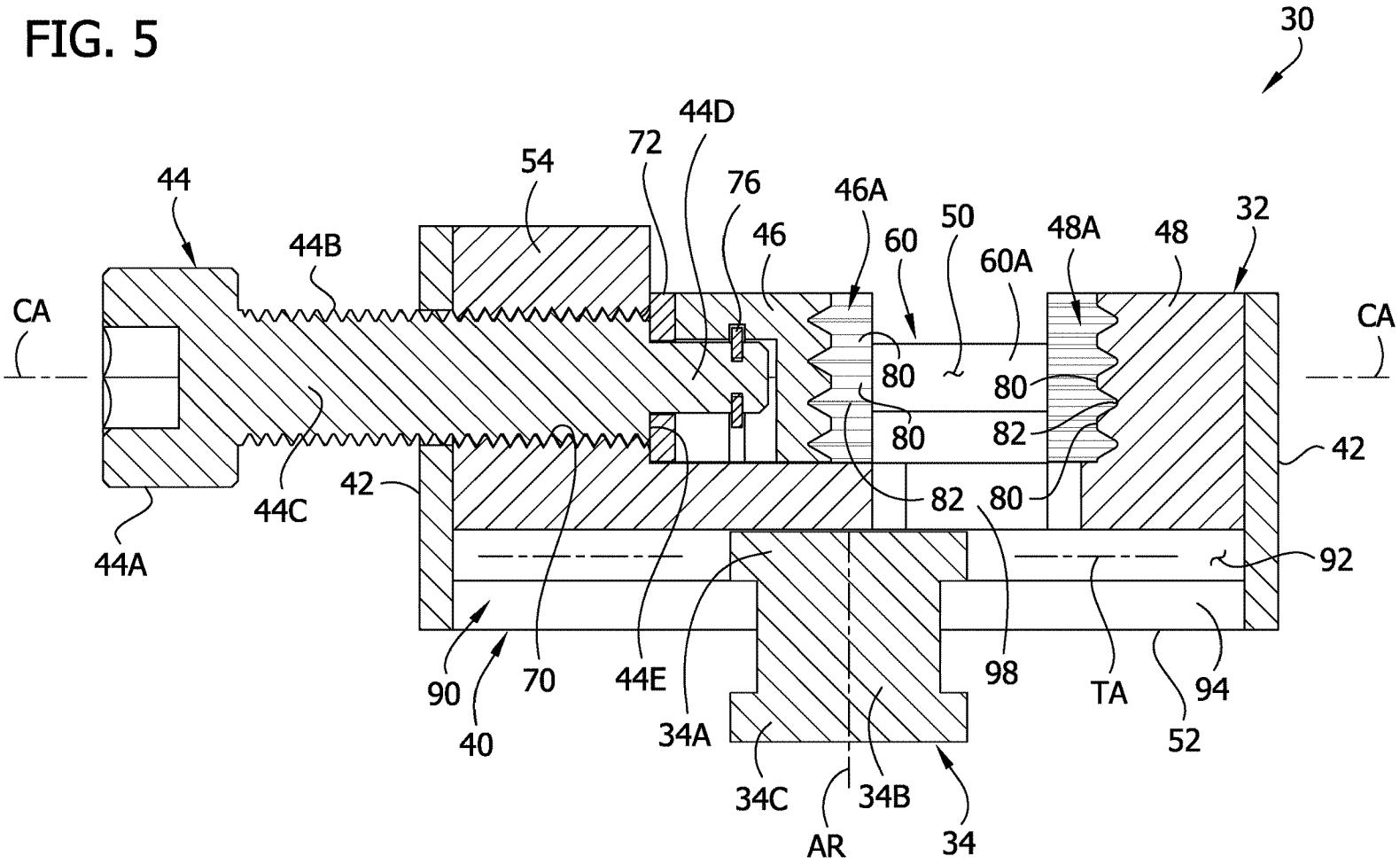
FIG. 5 is a section of the stuck shell remover taken in a plane including line 5-5 of FIG. 2.
Figure 6:
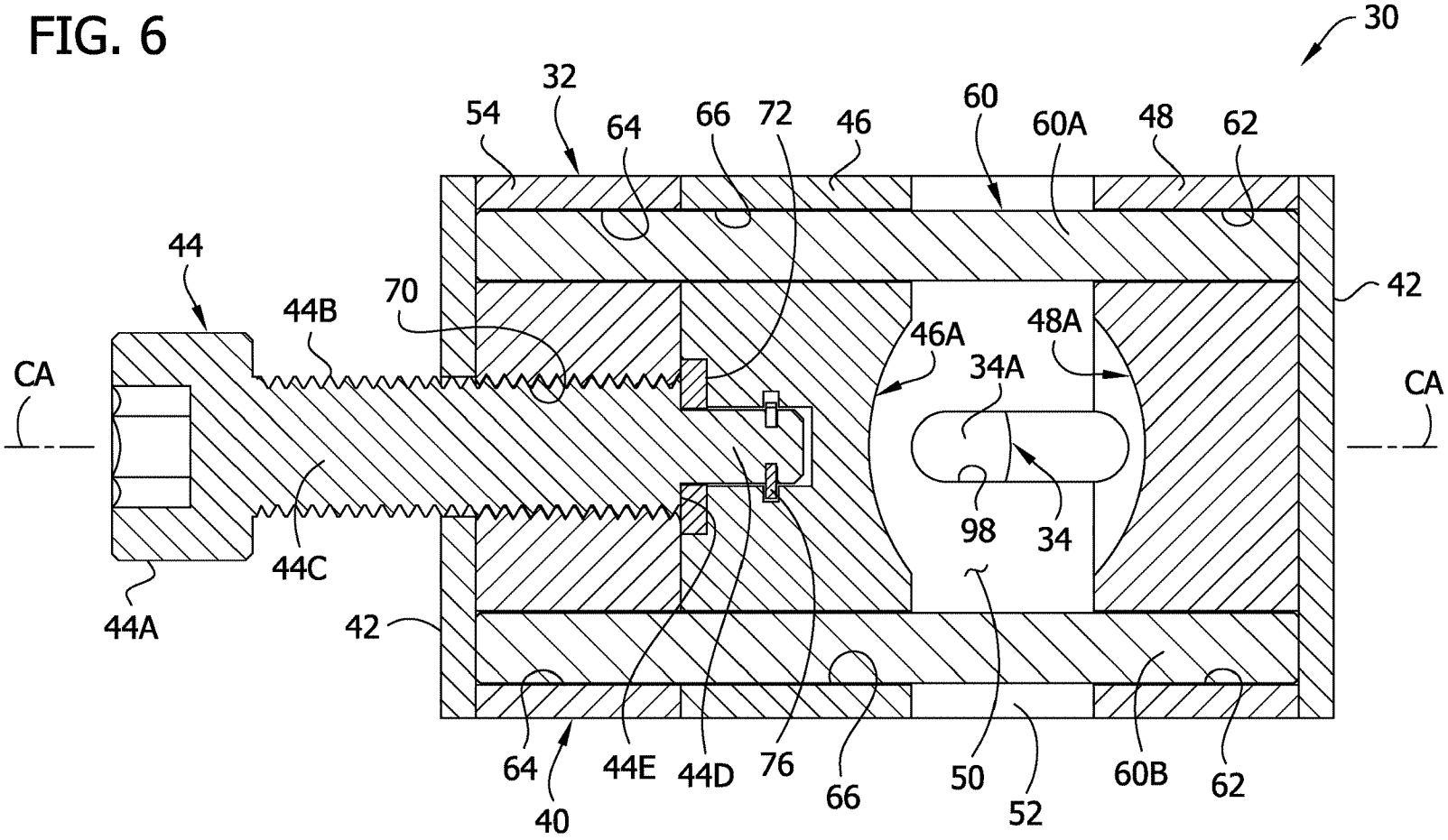
FIG. 6 is a section of the stuck shell remover taken in a plane including line 6-6 of FIG. 2.

The main body 40 defines a rectangular opening between the fixed jaw 48 and the hub 54 in which the movable clamp 46 is received and movable. The jaw 46 is movable between the retracted and clamping positions along a clamping axis CA (FIGS. 5, 6). The clamp 32 includes a guide 60 to guide movement of the movable jaw 46 along the clamping axis CA. In the illustrated embodiment, the guide 60 includes two slides 60A, 60B in the form of cylindrical bars on opposite sides of the shell recess 50. The slides 60A, 60B have longitudinal axes that are parallel with the clamping axis CA. The slides 60A, 60B have opposite ends mounted to the fixed jaw 48 and the hub 54, respectively. The fixed jaw 48 defines two guide mounts 62 (FIG. 6) in the form of cylindrical bores for mounting ends of the slides 60A, 60B, and the hub 54 defines two guide mounts 64 in the form of cylindrical bores for mounting the other ends of the slides. The cylindrical bores 62 extend through the fixed jaw 48 and hub 54 and have outer ends closed by the end caps 42 to retain the slides in the guide mounts 62, 64. The movable jaw 46 is mated with the slides 60A, 60B and movable along the slides. In particular, the movable jaw 46 includes two followers 66 in the form of cylindrical bores on opposite sides of the jaw face 46A. It will be appreciated that other types of guides (e.g., other types of bars, etc.) and other types of followers can be used, and the guides and followers can be omitted, without departing from the scope of the present invention. Moreover, other mated relationships between a guide and follower can be used.

The hub 54 supports the actuator 44 for moving the jaw 46 between the retracted and clamping positions. The hub 54 defines an actuator mount 70 (FIG. 6) in the form of a threaded opening forming a threaded connection with the actuator 44. The actuator 44 generally includes a head 44A and an elongate shaft 44B. The actuator 44 has a longitudinal axis that in the illustrated embodiment defines the clamping axis CA and is coplanar with the longitudinal axes of the slides 60A, 60B. The head 44A is configured to be engaged by a tool such as a hex bit or hex wrench to rotate the actuator 44 to drive the actuator along the clamping axis. In particular, the head 44A includes a bore having a hexagonal cross-sectional shape. The shaft 44B includes a threaded section 44C forming the threaded connection with the threaded opening 70 of the hub 54 and a non-threaded connecting section 44D located distally from the threaded section. A shoulder 44E at the distal end of the threaded section 44C engages a side of the movable jaw 46 for pushing the jaw toward the clamping position. The movable jaw 46 includes a washer 72 positioned for engagement by the shoulder 44E. The connecting section 44D of the shaft 44B has a lesser diameter than the threaded section 44C and extends into a bore in the movable jaw 46. A fastener 76 in the form of an E-clip is received in a circumferential groove in the connecting section 44D and in a slot in the movable jaw 46 to secure the connecting section to the movable jaw. Other fasteners can be used without departing from the scope of the present invention. When the actuator 44 is rotated to move the movable jaw 46 away from the fixed jaw 48, the E-clip 76 bears against the movable jaw and pulls the jaw toward the hub 54. It will be appreciated that other types of actuators can be used without departing from the scope of the present invention.

Figure 3:
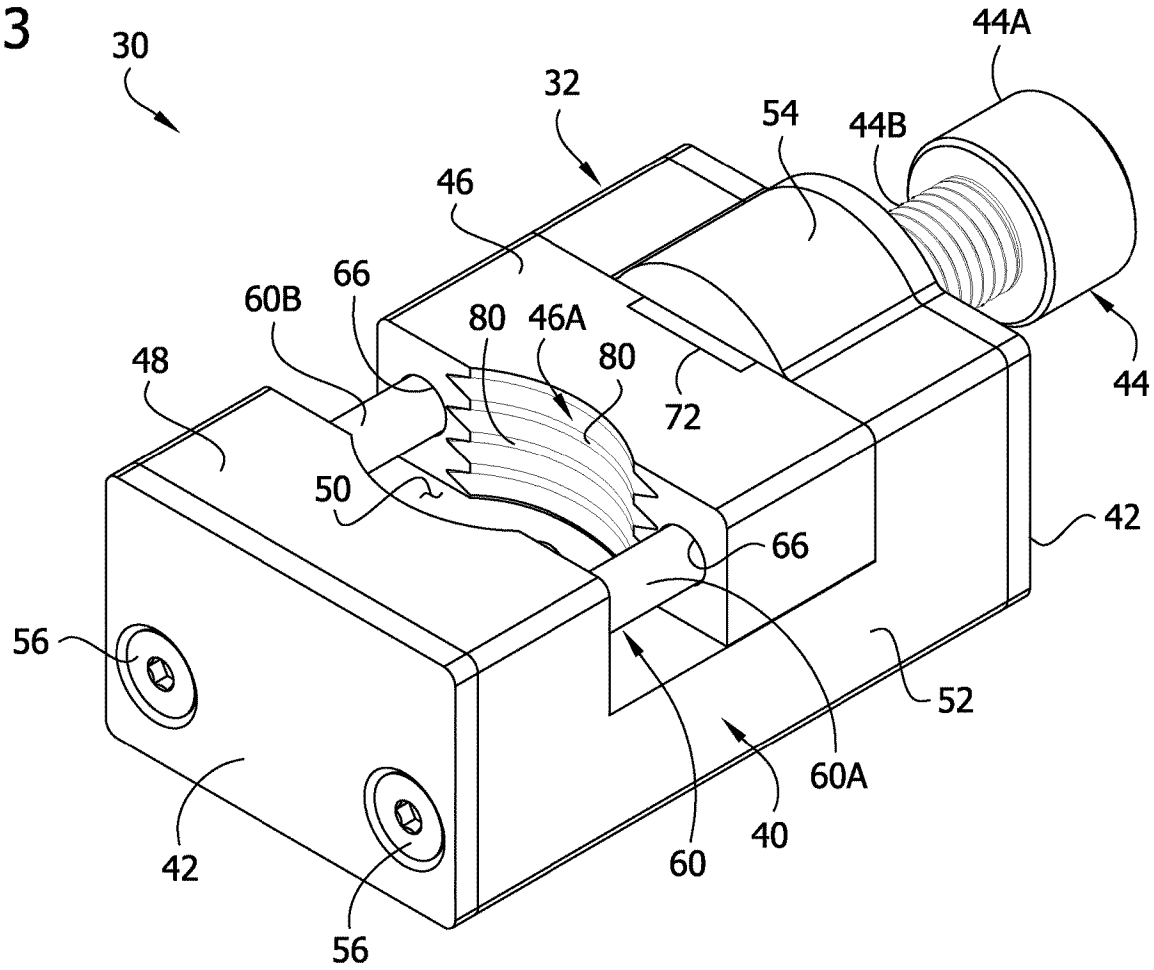
FIG. 3 is a rear perspective of the stuck shell remover.

Referring to FIGS. 3 and 5, the jaw faces 46A, 48A are configured to grip a stuck shell C to remove the shell from the die 22. The jaw faces 46A, 48A are concave and arcuate to generally conform to curved outer surfaces of shells of various sizes. In the illustrated embodiment, the jaw faces include a plurality of teeth 80. The teeth 80 are defined by a plurality of arcuate ribs protruding laterally from the jaw 46, 48 toward the shell recess 50. The teeth 80 are separated by a plurality of arcuate recesses 82. In use, the rim of the shell C may become seated in corresponding arcuate recesses 82 of the jaws 46, 48 to assist the jaws in gripping the shell. Moreover, if sufficient force is applied to the movable jaw 46 by the actuator 44, the teeth 80 may deform the shell C by pressing into the opposite sides of the shell. This increases the grip of the jaws 46, 48 on the shell. The guide 60 assists in maintaining the movable jaw 46 square to the fixed jaw 48 when substantial force is applied to the movable jaw to clamp the stuck shell. Jaws having other configurations can be used without departing from the scope of the present invention.

Figure 4:
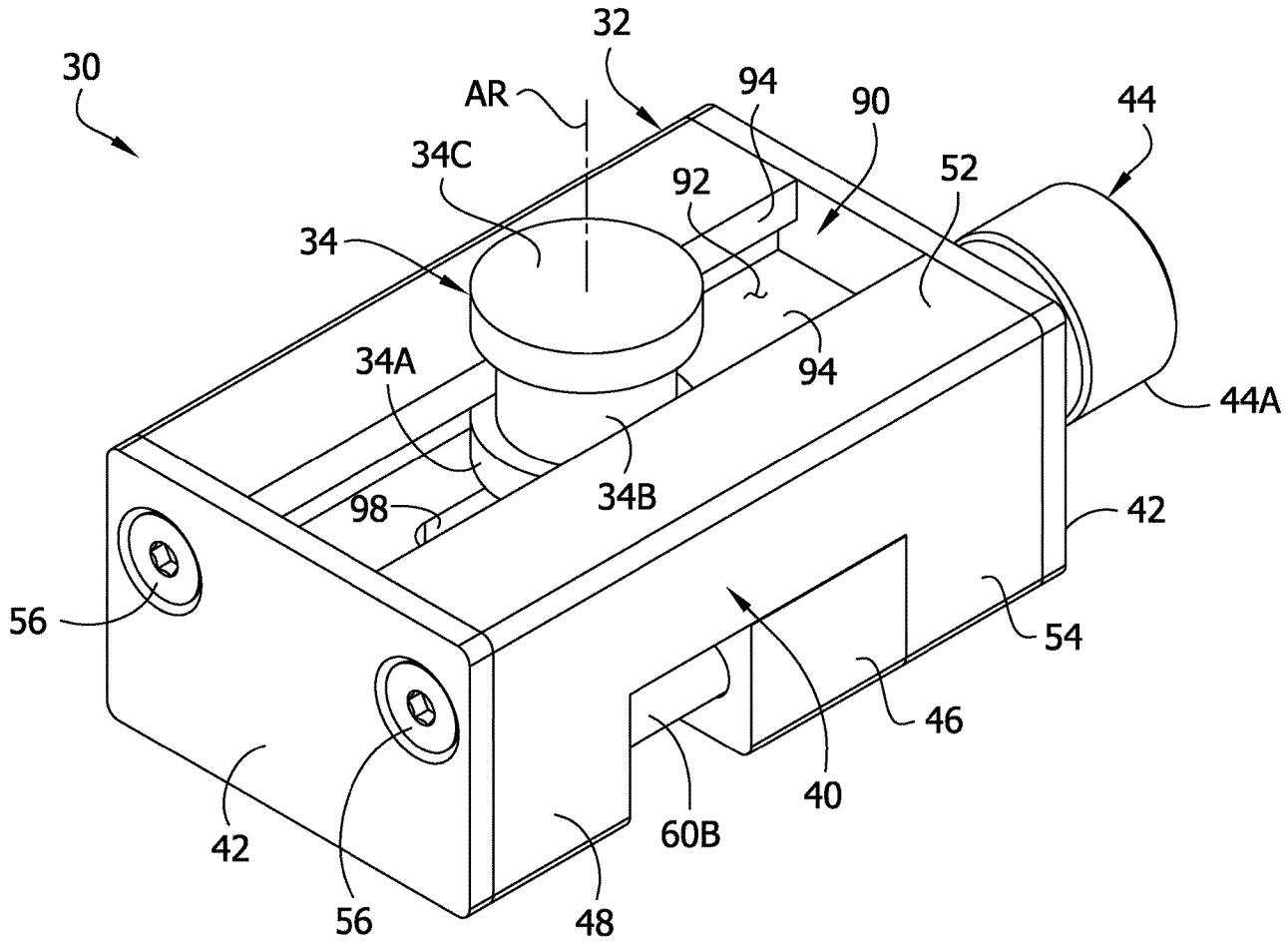
FIG. 4 is a bottom perspective of the stuck shell remover.

In an aspect of the stuck shell remover 30, the clamp 32 is movable with respect to the press connector 34 to facilitate alignment of the clamp with the stuck shell C. As explained in further detail below, the clamp 32 can slide and rotate with respect to the press connector 34 to properly position the clamp for clamping on the stuck shell C. Referring to FIGS. 4 and 5, the press connector 34 has a spool shape and includes a generally cylindrical head 34A, neck 34B, and foot 34C. The head 34A and foot 34C have greater diameters than the neck 34B and define respective flanges extending outboard of the neck.

The foot 34C of the press connector 34 is configured for being connected to the shell holder connector 16A of the press 10. As explained above with reference to FIG. 1, the shell holder connector 16A defines a recess 16B into which the shell holder 24 is laterally slidable, and a flange 16C (FIG. 7) above the recess retains the shell holder on the shell holder connector. The press connector 34 is mountable on the press 10 in a similar fashion as the shell holder 24. With the shell holder 24 removed from the shell holder connector 16A, the foot 34C of the press connector 34 is laterally slid into the recess 16B below the flange 16C of the shell holder connector 16A. As shown in FIG. 7, the flange 16C of the shell holder connector 16A retains the foot 34C on the shell holder connector, and the neck 34B of the press connector 34 extends upward through an opening in the top of the shell holder connector. The press connector 34 may be further retained by a set screw on the ram and/or a detent arrangement (e.g., spring biased ball detent) on the ram (not shown). Accordingly, when a shell C becomes stuck in the die 22, the user can conveniently remove the shell holder 24 from the ram 16 and install the stuck shell remover 30 on the ram.

The press connector 34 is secured to the clamp 32 by reception of the head 34A of the press connector on a track 90 of the clamp. The track 90 has a track axis TA (FIG. 5) along which the press connector 34 is movable and which is parallel with the clamping axis CA. The track 90 includes a slot 92 in the base 52 of the clamp 32 capturing the head 34A of the press connector 34. The slot 92 has a T-shaped cross section transverse to the track axis TA. The slot 92 is partially defined by rails 94 extending along the track 90 between opposite ends of the track. The rails 94 capture and prevent downward removal of the head 34A from the track 90. The neck 34B is sized to be freely slidable between and along the rails 94. The arrangement is such that the press connector 34 is freely rotatable with respect to the clamp 32 about an axis of rotation AR of the press connector, which in the illustrated embodiment is perpendicular to and coplanar with the clamping axis CA and track axis TA. The track 90 is closed at its opposite ends by the end caps 42. In manufacture, the ends of the track 90 can be closed by the end caps 42 after installing the head 34A of the press connector 34 in the track 90. The arrangement is such that the clamp 32 is freely slidable and rotatable with respect to the press connector 34.

The press connector 34 being slidable and rotatable with respect to the clamp 32 provides several benefits. Rotation of the clamp 32 permits the user to angularly orient the actuator 44 however is convenient for the user. For example, a user may need to position the actuator 44 where access to the actuator is not obstructed by the press 10. Sliding of the clamp 32 facilitates alignment of the clamp with various sizes of shells so that the clamp can pull directly downward on the shell to remove the shell in line with the die 22 rather than tending to pull the shell at an angle with respect to the die. Driving the movable jaw 46 toward the clamping position tends to not only urge the movable jaw against the shell C but also tends to draw the fixed jaw 48 toward the shell due to the slide connection of the clamp 32 and press connector 34. For example, when the shell is positioned in the shell recess 50 between the jaws 46, 48, and the actuator 44 begins moving the movable jaw 46 toward the clamping position, the movable jaw will initially move relative to the shell C, and when the movable jaw engages the shell and rotation of the actuator continues, the fixed jaw 48 will move closer to the shell until the jaws engage opposite sides of the shell. This results in the jaw faces 46A, 48A being about equidistant from the axis of rotation AR (FIG. 8) of the press connector 34 no matter the diameter of the shell. Accordingly, the die 22, shell C, clamp 32, press connector 34, and/or ram 16 are properly aligned so that the clamp pulls the shell straight downward out of the die in line with the die and ram rather than tending to pull the shell at an angle.

In another aspect of the stuck shell remover, the clamp 32 includes a depriming pin recess 98 to provide clearance for the depriming pin 22A (if equipped) of the die 22. For example, the die 22 shown in FIGS. 7-9 includes the depriming pin 22A configured to push a spent primer out of a primer pocket of the shell C as the shell is pushed upward into the die. The depriming pin 22A is secured to an upper end of the die and extends downward in a shell receiving bore of the die so that as the shell is moved upward the depriming pin pushes the spent primer out of the primer pocket. If the shell C becomes stuck in the die 22, the depriming pin 22A may protrude downward from the bottom of the shell through the primer pocket, as shown in FIG. 7. Referring to FIGS. 5-7, the base 52 of the clamp body 40 includes a recess 98 in the form of an elongate slot to receive the distal end of the depriming pin 22A if needed. Accordingly, the distal end of the depriming pin 22A does not limit upward movement of the clamp 32, and the clamp can be moved upward until the clamp engages the die 22 (as shown in FIG. 7) or the base 52 of the clamp engages the bottom of the shell C.

In a method of using the stuck shell remover 30, when a shell C becomes stuck in a die 22 on the press 10, the shell holder 24 can be removed from the ram 16 and replaced with the stuck shell remover. The foot 34C of the press connector 34 is connected to the shell holder connector 16A of the press 10 as explained above to mount the stuck shell remover 30 on the press. The press 10 is actuated to move the clamp 32 toward the stuck ammunition shell C as shown in FIG. 7. The clamp 32 can be manually or automatically slid and/or rotated on the press connector 16A to properly position the clamp with respect to the shell C. The actuator 44 is rotated to clamp the stuck ammunition shell C with the jaws 46, 48 as shown in FIG. 8. The slide connection of the clamp 32 and press connector 34 permits proper alignment of the jaws 46, 48 with the ram 16 for pulling the shell C straight downward out of the die 22. As shown in FIG. 9, when the shell C is clamped, the press 10 is actuated to move the clamp 32 away from the die 22 to remove the stuck ammunition shell from the die. The user benefits from the mechanical advantage of the press 10 and does not need to remove the die 22 from the press to remove the stuck shell C.

It will be apparent that modifications and variations are possible without departing from the scope of the invention defined in the appended claims. For example, components of the stuck shell remover can have other configurations or be omitted without departing from the scope of the present invention.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A stuck shell remover for removing a stuck ammunition shell from a die on an ammunition press, the stuck shell remover comprising:

a clamp including a first jaw, a second jaw, and a base supporting the first and second jaws, the first jaw being movable with respect to the second jaw between a retracted position and a clamping position, the first jaw in the retracted position being a first distance from the second jaw to receive the shell therebetween, the first jaw in the clamping position being a second distance less than the first distance from the second jaw for clamping the shell; and an ammunition press connector secured to the clamp and configured to connect to the ammunition press;

wherein the clamp includes a track and the ammunition press connector includes a head movable along the track, the track defining a track axis along which the head is movable with respect to the base, the first jaw being movable from the retracted position to the clamping position along a clamping axis, the track axis being generally parallel with the clamping axis.

2. The stuck shell remover as set forth in claim 1, wherein the ammunition press connector is movably secured to the clamp.

3. The stuck shell remover as set forth in claim 1, wherein the ammunition press connector is rotatably secured to the clamp.

4. The stuck shell remover as set forth in claim 1, wherein the ammunition press connector is rotatable on the track about an axis of rotation.

5. The stuck shell remover as set forth in claim 4, wherein the axis of rotation is generally perpendicular to the track axis and the clamping axis.

6. The stuck shell remover as set forth in claim 4, wherein the axis of rotation is generally coplanar with the track axis and the clamping axis.

7. The stuck shell remover as set forth in claim 1, wherein the head is slidable along the track.

8. The stuck shell remover as set forth in claim 7, wherein the head is rotatable on the track.

9. The stuck shell remover as set forth in claim 1, wherein the head defines a flange captured by the track.

10. The stuck shell remover as set forth in claim 1, wherein the ammunition press includes a shell holder connector for connecting a shell holder to the press, and the ammunition press connector of the stuck shell remover is configured to connect to the shell holder connector of the ammunition press.

11. The stuck shell remover as set forth in claim 10, wherein the ammunition press connector includes a foot defining a flange configured to be captured by the shell holder connector of the ammunition press.

12. A stuck shell remover for removing a stuck ammunition shell from a die on an ammunition press, the stuck shell remover comprising:

a clamp including a first jaw, a second jaw, and a base supporting the first and second jaws, the first jaw being movable with respect to the second jaw along a clamping axis between a retracted position and a clamping position, the first jaw in the retracted position being a first distance from the second jaw to receive the shell therebetween, the first jaw in the clamping position being a second distance less than the first distance from the second jaw for clamping the shell; and an ammunition press connector secured to the clamp and configured to connect to the ammunition press;

wherein the clamp includes a hub supported by the base and an actuator supported by the hub, the actuator comprising a threaded shaft received in a threaded opening in the hub and rotatable with respect to the hub to move the threaded shaft in a direction generally parallel with the clamping axis and to drive the first jaw along the clamping axis toward the clamping position.

13. The stuck shell remover as set forth in claim 12, wherein the clamp includes a guide along which the first jaw is movable between the retracted and clamping positions.

14. The stuck shell remover as set forth in claim 13, wherein the first jaw includes a follower mated with the guide.

15. The stuck shell remover as set forth in claim 13, wherein the first jaw includes a jaw face for engaging the stuck shell and first and second followers on opposite sides of the jaw face, the guide including first and second slides on opposite sides of the jaw face, the first follower slidable along the first slide and the second follower slidable along the second slide to guide the first jaw from the retracted position to the clamping position.

16. The stuck shell remover as set forth in claim 1, wherein the base defines a depriming pin recess between the first and second jaws for receiving a depriming pin of the die.

17. A method of using a stuck shell remover to remove a stuck ammunition shell from a die on an ammunition press, the method comprising:

connecting an ammunition press connector of the stuck shell remover to the ammunition press to mount the stuck shell remover on the ammunition press;

actuating the press to move a clamp of the stuck shell remover toward the stuck ammunition shell;

clamping the stuck ammunition shell with the clamp; and actuating the press to move the clamp away from the die to remove the stuck ammunition shell from the die;

wherein clamping the stuck ammunition shell with the clamp comprises deforming the stuck ammunition shell with the clamp to grip the stuck ammunition shell with the clamp.

18. The method as set forth in claim 17, wherein clamping the stuck shell comprises moving a first jaw of the clamp laterally with respect to a longitudinal axis of the shell toward a second jaw of the clamp to clamp the shell between the first and second jaws.

19. The method as set forth in claim 17, further comprising, while the ammunition press connector is connected to the ammunition press, moving the clamp with respect to the ammunition press connector to position the clamp to clamp the stuck ammunition shell.

20. A stuck shell remover for removing a stuck ammunition shell from a die on an ammunition press, the stuck shell remover comprising:

a clamp including a first jaw, a second jaw, and a base supporting the first and second jaws, the first and second jaws bounding a stuck ammunition shell receiving space therebetween, the stuck ammunition shell receiving space having a top opening and a height extending downward from the top opening, the first jaw being movable with respect to the second jaw between a retracted position and a clamping position, the first jaw in the retracted position being a first distance from the second jaw to receive the shell in the stuck ammunition shell receiving space therebetween, the first jaw in the clamping position being a second distance less than the first distance from the second jaw for clamping the shell in the stuck ammunition shell receiving space, the first jaw including multiple gripping structures protruding toward the stuck ammunition shell receiving space for gripping the stuck shell at different locations, at least some of said multiple gripping structures being spaced from each other along the height of the stuck ammunition shell receiving space; and an ammunition press connector secured to the clamp and configured to connect to the ammunition press.

21. The stuck shell remover as set forth in claim 20, wherein the second jaw includes multiple gripping structures protruding toward the stuck ammunition shell receiving space for gripping the stuck shell at different locations, at least some of the multiple gripping structures of the second jaw being spaced from each other along the height of the stuck ammunition shell receiving space.

22. The stuck shell remover as set forth in claim 21, wherein the first jaw includes an arcuate jaw face having the multiple gripping structures, the multiple gripping structures comprising vertically spaced teeth configured to engage the stuck shell when the stuck shell is clamped by the clamp.

* * * * *